US006026755A

United States Patent [19]

Long

[11] Patent Number: 6,026,755

[45] **Date of Patent: *Feb. 22, 2000**

[54] COUNTERBALANCE APPARATUS

[76] Inventor: Dennis L. Long, 2161 Thornapple Dr., Grand Rapids, Mich. 49546

[ * ] Notice: This patent is subject to a terminal disclaimer.

[21] Appl. No.: 09/024,518

[22] Filed: Feb. 13, 1998

Related U.S. Application Data

[63] Continuation-in-part of application No. 08/584,266, Jan. 11, 1996, Pat. No. 5,718,406.

[60] Provisional application No. 60/070,132, Dec. 31, 1997.

[51] Int. Cl.[7] ..... A47B 9/02

[52] U.S. Cl. ..... 108/147; 248/600; 248/624; 248/623; 248/162.1; 267/175

[58] Field of Search ..... 108/147, 146, 108/145, 147.19, 50.02; 267/175, 177, 178, 180, DIG. 1; 248/600, 601, 622, 623, 624, 631, 648, 651, 669, 123.11, 188.2, 188.5, 162.1, 157, 421, 405, 406.1, 404, 364

[56] References Cited

U.S. PATENT DOCUMENTS

| | | | |
|---|---|---|---|
| 300,887 | 6/1884 | Owen . | |
| 424,711 | 4/1890 | Homan . | |
| 484,707 | 10/1892 | Garee . | |
| 660,868 | 10/1900 | Reid . | |
| 2,649,345 | 9/1953 | Hubbard . | |
| 2,918,273 | 12/1959 | Whisler et al. . | |
| 3,543,282 | 11/1970 | Sautereau . | |
| 3,582,059 | 6/1971 | Van Oot . | |
| 3,845,926 | 11/1974 | Wahls . | |
| 3,885,764 | 5/1975 | Pabreza . | |
| 4,130,069 | 12/1978 | Evans et al. . | |
| 4,156,391 | 5/1979 | Ubezio . | |
| 4,183,689 | 1/1980 | Wirges et al. . | |
| 4,351,245 | 9/1982 | Laporte . | |
| 4,381,714 | 5/1983 | Henneberg et al. . | |
| 4,415,135 | 11/1983 | French . | |
| 4,619,208 | 10/1986 | Kurrasch . | |
| 4,625,657 | 12/1986 | Little et al. . | |
| 4,651,652 | 3/1987 | Wyckoff . | |
| 5,243,921 | 9/1993 | Kruse et al. . | |
| 5,311,827 | 5/1994 | Greene . | |
| 5,322,025 | 6/1994 | Sherman et al. . | |
| 5,400,721 | 3/1995 | Greene . | |
| 5,443,017 | 8/1995 | Wacker et al. . | |
| 5,456,191 | 10/1995 | Hall . | |
| 5,513,825 | 5/1996 | Gutgsell . | |
| 5,718,406 | 2/1998 | Long | 248/600 |
| 5,819,669 | 10/1998 | Eyre | 108/147 |

FOREIGN PATENT DOCUMENTS

| | | |
|---|---|---|
| 281884 | 12/1927 | United Kingdom . |

*Primary Examiner*—Ramon O. Ramirez
*Assistant Examiner*—Stephen S. Wenstler
*Attorney, Agent, or Firm*—Ian C. McLeod; Mary M. Moyne

[57] ABSTRACT

A counterbalance apparatus (10) for use in moving a work surface (102) is described. The apparatus includes an upper, lower and center member (12, 14 and 24), a pair of inner and outer cam surfaces (20, 22 and 26) and a pair of inner and outer cam followers (58, 60 and 62). The outer cam surfaces are located on the lower member. The inner cam surfaces are located on the center member. The lower member is telescopingly mounted within the upper member. The top (24A) of the center member is connected to the top (12A) of the upper member. One end of the springs (46 and 47) is mounted in the bracket (48) which is connected by connector arms (50 and 52) to the cam followers. The other end of the spring is adjacent the top of the upper member and the center member. In use, as a force is applied to move the work surface in a given direction, the center member moves into or out of the lower member. As the center member moves, the spring is compressed or decompressed and the cam followers move along the inner and outer cam surfaces. The cam followers exert a force on the cam surfaces which compensates for the force of the springs and the preadjusted force.

41 Claims, 10 Drawing Sheets

COUNTERBALANCE APPARATUS

CROSS-REFERENCES TO RELATED APPLICATIONS

This is a continuation-in-part of U.S. application Ser. No. 08/584,266 filed Jan. 11, 1996, now U.S. Pat. No. 5,718,406. This application claims the benefit of U.S. Provisional Application Ser. No. 60/070,132 filed Dec. 31, 1997.

BACKGROUND OF THE INVENTION (1) Field of the Invention

The present invention relates to a counterbalance apparatus for use in moving a work surface. In particular, the present invention relates to a counterbalance apparatus for vertically moving the work surface of a work station where the counterbalance apparatus exerts a constant force on the moving work surface. A counterbalance apparatus mechanically related to the current counterbalance apparatus is described in Ser. No. 08/584,266 filed on Jan. 11, 1996 which is herein incorporated by reference. A U.S. Provisional Application was filed on Dec. 31, 1997, as Ser. No. 60/070,132.

(2) Description of the Related Art

The related art has shown various systems and mechanisms for vertically adjusting work surfaces or table tops. Illustrative are U.S. Pat. No. 484,707 to Garee; U.S. Pat. No. 2,649,345 to Hubbard; U.S. Pat. No. 4,130,069 to Evans et al; U.S. Pat. No. 4,183,689 to Wiraes et al; U.S. Pat. No. 4,381,714 to Henneberg et al; U.S. Pat. No. 4,619,208 to Kurrasch; U.S. Pat. No. 4,651,652 to Wyckoff; U.S. Pat. No. 5,243,921 to Kruse et al; U.S. Pat. No. 5,322,025 to Sherman et al; U.S. Pat. No. 5,443,017 to Wacker et al and U.S. Pat. No. 5,456,191 to Hall.

In addition, U.S. Pat. Nos. 5,400,721 and 5,311,827 both to Greene show a load compensator for a spring counterweight mechanism which includes a snail cam.

U.S. Pat. No. 660,868 to Reid shows a counterbalance system for a table top which uses a chain and pulley with a weight. Similarly, U.S. Pat. No. 3,543,282 to Sautereau describes a drawing board having a counterbalance mechanism which includes pulleys and cables and which allows for easier vertical movement of the drawing board. U.S. Pat. No. 4,156,391 to Ubezio describes a counterbalance apparatus for table tops which uses a leaf spring as the means for providing the counterbalancing force. U.S. Pat. No. 4,351,245 to Laporte describes a counterweight system which uses cables and pulleys in combination with a cam mechanism.

Also, of some interest are U.S. Pat. No. 2,918,273 to Whisler et al and U.S. Pat. No. 3,582,059 to Van Ooy. Whisler et al shows a control device for a spring. Van Ooy describes a shock absorber where the wire of the compression spring is provided with one or more roller shaped guide members coaxial with the wire and rotatable about it. The guide members around the compression spring substantially eliminate wear and noise owing to sliding friction.

Only of minimal interest are U.S. Pat. No. 300,887 to Owen; U.S. Pat. No. 424,711 to Homan; U.S. Pat. No. 3,845,926 to Wahls; U.S. Pat. No. 3,885,764 to Pabreza; U.S. Pat. No. 4,415,135 to French; U.S. Pat. No. 4,625,657 to Little et al and U.S. Pat. No. 5,513,825 to Gutgsell. Owen shows an adjustable trestle for supporting scaffolding. Homan shows an extendable lamp standard. Wahls shows a seat pedestal which uses a vertically extending double telescoping tube to raise and lower the seat. The pedestal also includes a toggle linkage locking mechanism for locking the pedestal at a given height. Pabreza describes a telescoping seat pedestal which uses an elastomer block as a locking means. French describes a device for supporting a chair seat which uses a hydraulic cylinder. The hydraulic cylinder uses the flow of fluid to control the raising and lowering of the seat and the lack of fluid flow to lock the seat in place. Little et al shows a retractable keyboard support. Gutgsell shows a telescopic adjustable height apparatus having a locking means.

Also of some interest is United Kingdom Patent No. 281,884 to Coppock which shows a folding table having an adjustable height.

There remains the need for a counterbalance mechanism which allows for vertical movement of the table top or work surface at a constant rate by application of a constant force and which is easily installed into an existing table or work station.

Objects

It is therefore an object of the present invention to provide a counterbalance apparatus which allows for vertical movement of a work surface using a constant force. Further, it is an object of the present invention to provide a method for vertically moving the work surface of a work station using a constant force. Further still, it is an object of the present invention to provide a counterbalance apparatus which has a damper which prevents the work surface from exceeding a predetermined speed. Still further, it is an object of the present invention to provide a counterbalance apparatus which allows for adjustment of the initial preload on the apparatus to compensate for the change in load on the work surface without changing the amount of force needed to move the work surface. Further still, it is an object of the present invention to provide a counterbalance apparatus which is easily and quickly installed into an existing table or work station. Further, it is an object of the present invention to provide a counterbalance apparatus which is durable and inexpensive to manufacture.

These and other objects will become increasingly apparent by reference to the following drawings and the description.

DESCRIPTION OF THE PREFERRED EMBODIMENT

Figure 1:
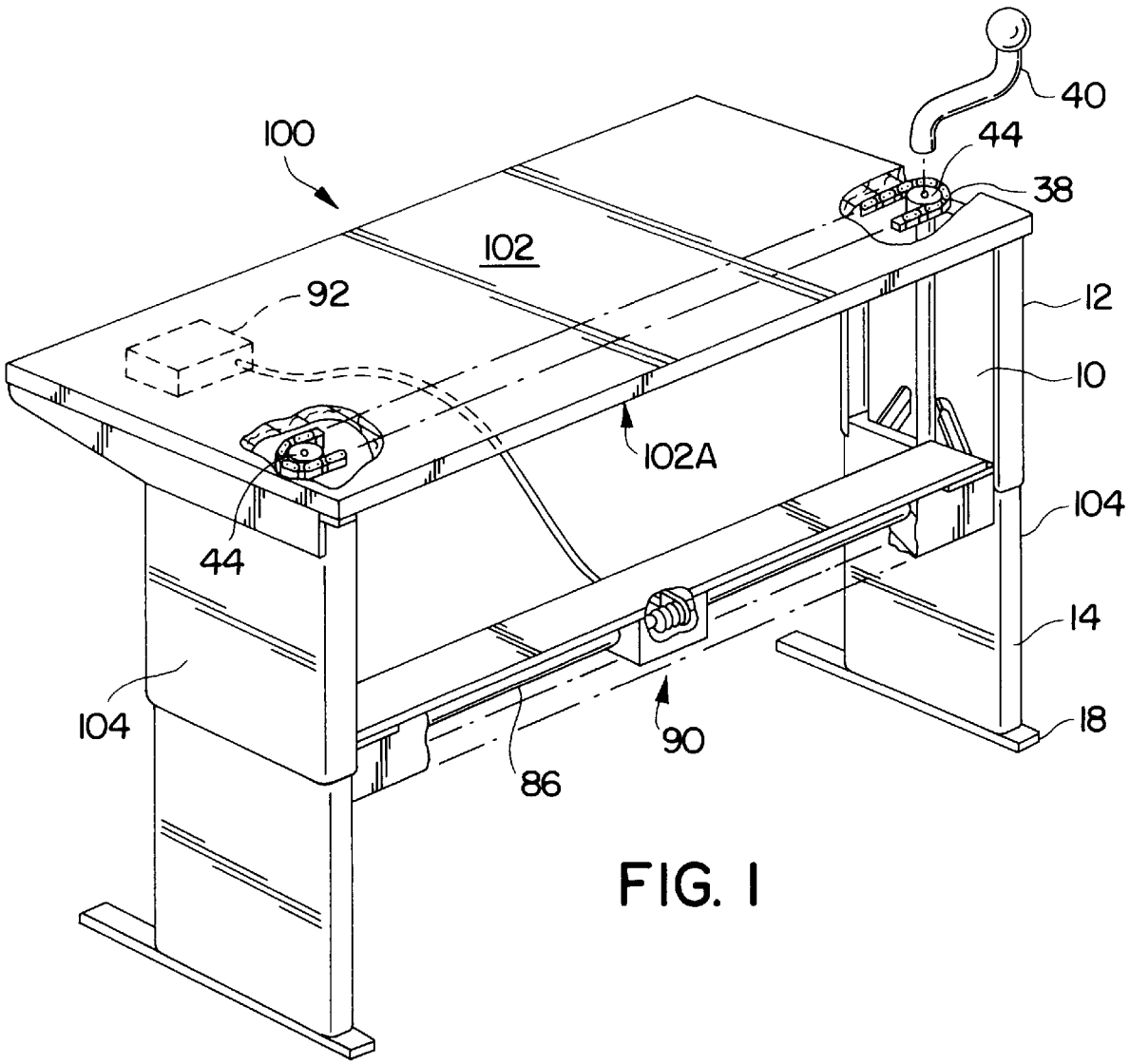
FIG. 1 is a perspective view of the counterbalance apparatus 10 mounted on a work station 100 with the work surface 102 in the raised position.

The present invention relates to a counterbalance apparatus, the improvement which comprises: a first member defining a longitudinal axis and having opposed ends with at least one wall between the ends; a second member slidably mounted along the first member so as to be along the longitudinal axis and having opposed ends with at least one wall between the ends; a pair of first cam surfaces located on the wall of the first member such that one first cam surface is a mirror image of the other first cam surface on opposed sides of the longitudinal axis; a pair of second cam surfaces located on the wall of the second member such that one second cam surface is a mirror image of the other second cam surface on opposed sides of the longitudinal axis wherein the pairs of first and second cam surfaces define oppositely inclined paths and wherein with the first and second members in an extended position, each of the first and second cam surfaces are spaced apart from the other with a space between them perpendicular to the longitudinal axis and wherein each of the first and second cam surfaces are located one above the other along the longitudinal axis; a pair of cam followers positioned adjacent and in contact with the pairs of first and second cam surfaces in the space between each of the first and the second cam surfaces and which move in the oppositely inclined paths defined by the first and second cam surfaces; and a resilient means with opposed ends and connected at one end to the pair of cam followers and at the other end to the second member so that the first and second members are in the extended position and so that when the resilient means is compressed, the cam followers move along the oppositely inclined paths of the first and second cam surfaces as the first and second members are moved together to provide a counterbalance for a weight on one of the opposed ends of the first and second members.

Further, the present invention relates to a work station with a counterbalance movable work surface and a support means for the work surface of the work station with a counterbalance apparatus within the support means for the movement which comprises: the counterbalance apparatus including a first member defining a longitudinal axis and having opposed ends with at least one wall between the ends; a second member slidably mounted along the first member so as to be along the longitudinal axis and having opposed ends with at least one wall between the ends; a pair of first cam surfaces located on the wall of the first member such that one first cam surface is a mirror image of the other first cam surface on opposed sides of the longitudinal axis; a pair of second cam surfaces located on the wall of the second member such that one second cam surface is a mirror image of the other second cam surface on opposed sides of the longitudinal axis wherein the pairs of first and second cam surfaces define oppositely inclined paths and wherein with the first and second members in an extended position, each of the first and second cam surfaces are spaced apart from the other with a space between them perpendicular to the longitudinal axis and wherein each of the first and second cam surfaces are located one above the other along the longitudinal axis; a pair of cam followers positioned adjacent and in contact with the pairs of first and second cam surfaces in the space between each of the first and the second cam surfaces and which move in the oppositely inclined paths defined by the first and second cam surfaces; and a resilient means with opposed ends and connected at one end to the pair of cam followers and at the other end to the second member so that the first and second members are in the extended position and so that when the resilient means is compressed, the cam followers move along the oppositely inclined paths of the first and second cam surfaces as the first and second members are moved together to provide a counterbalance for a weight on one of the opposed ends of the first and second members; and locking means adjacent the counterbalance apparatus for securing the work surface of the work station against movement.

Still further, the present invention relates to a counterbalance apparatus, the improvement which comprises: a first member defining a longitudinal axis and having opposed ends with at least one wall between the ends; a second member slidably mounted along the first member so as to be along the axis and having opposed ends with at least one wall between the ends; a pair of first cams for the first member and a pair of second cams for the second member, each of the cams located on and between the first member and the second member, wherein the first and second cams have cam surfaces which define oppositely inclined paths and cam followers which move in the oppositely inclined paths with respect to the longitudinal axis and wherein at least one of the second member or first member is movable along the longitudinal axis relative to the other of the members to move the members together; and force storage mechanism with opposed ends which is connected at one end to the cam followers and at the other end to one end of the second member so as to bias the members apart.

The apparatus 10 can also be provided with a damper or safety cylinder 30 which increases the safety of the apparatus 10 by preventing accelerated movement of the object or work surface 102 if the load on the surface 102 or weight of the object is changed. The apparatus 10 preferably has an adjustment mechanism which allows for adjusting the apparatus 10 for the exact weight of the work surface 102 or object to be moved. This adjustment is preferably accomplished by adjusting the preload force on the springs 46 and 47 or other force storage mechanism which for the springs 46 and 47 is achieved by changing the initial amount of compression of the springs 46 and 47.

The apparatus 10 allows surfaces 102 or objects having some weight to be easily moved by applying a small force. The apparatus 10 can be used anywhere where it is necessary to move a heavy object using minimal force. The apparatus 10 creates a state of equilibrium neglecting friction in which the force acting on the work surface 102 or object is equal to the force exerted by the work surface 102 or object on the apparatus 10 thus, allowing heavy objects to be easily and safely moved. The counterbalance apparatus 10 has a variety of uses which include vertically raising the top of a table, the work surface 102 of a work station 100, an object or in a plant to raise and lower loads. The apparatus 10 can also be used to move objects or work surfaces 102 in other directions besides vertically. The apparatus 10 could be used to move a surface horizontally toward or away from a stationary object such as a wall.

Figure 2:
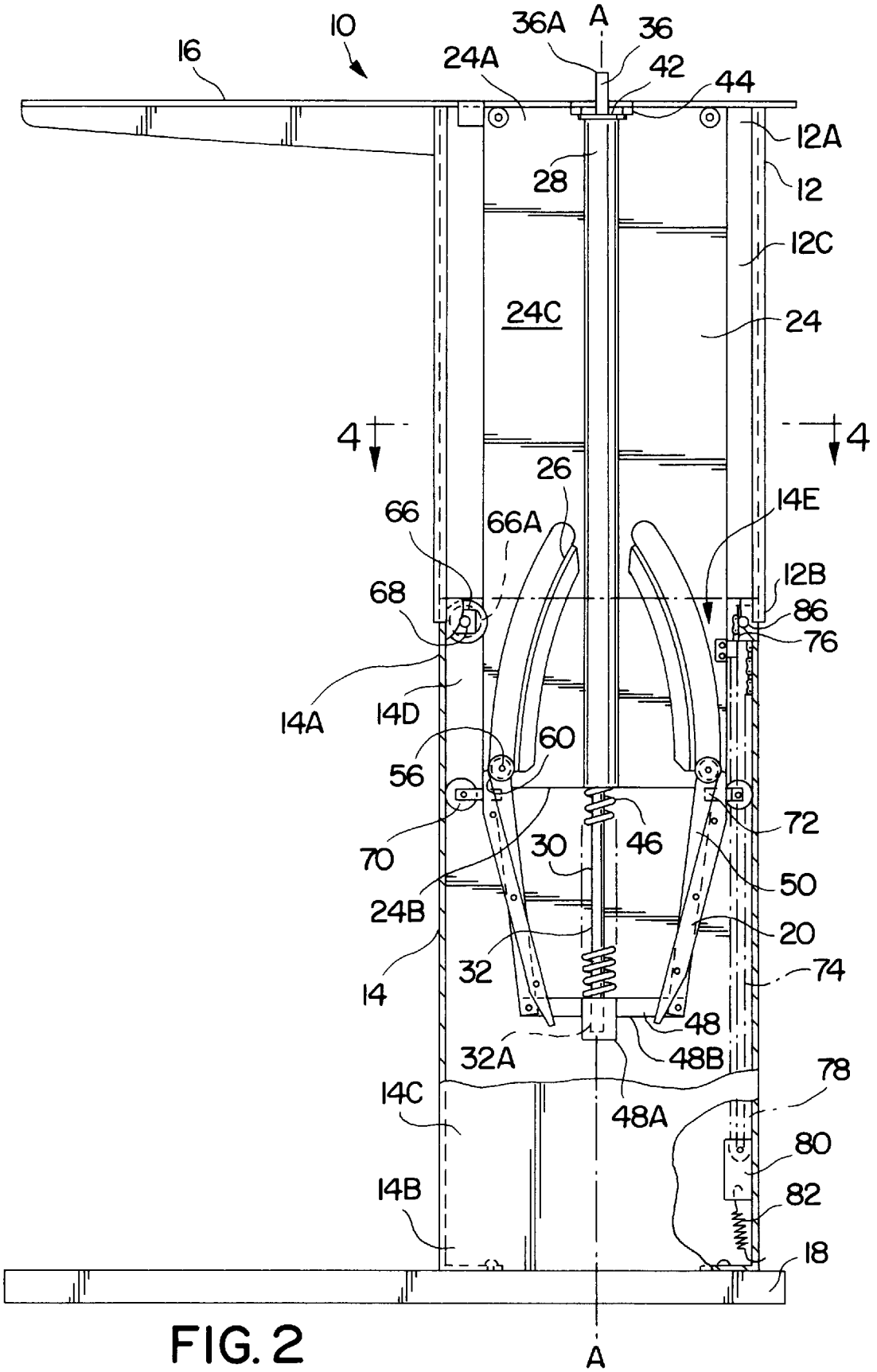
FIG. 2 is a side view of the counterbalance apparatus 10 in the fully raised position with a cutaway section showing the cam surfaces 20 and 26 and cam followers 56.

FIG. 1 shows the counterbalance or counterweight apparatus 10 of the present invention mounted in a leg 104 of a work station 100 for raising or lowering the work surface 102 of the work station 100. FIGS. 2 to 6 show the counterbalance apparatus 10 of the present invention for raising or lowering the work surface 102 of a work station 100 such as the top of a table (not shown). The apparatus 10 of the present invention includes an upper member 12, a lower member 14, a center member 24, a force storage mechanism or springs 46 and 47, a pair of cam followers 56 and pairs of cam surfaces 20, 22 and 26. In the preferred embodiment, with regard to the cam followers 56 and the cam surfaces 20, 22 and 26, the left half of the apparatus 10 is a mirror image of the right half of the apparatus 10 when divided along the vertical axis A—A (FIG. 2). The upper and lower members 12 and 14 preferably have a hollow rectangular shape with opposed open ends 12A, 12B, 14A and 14B. The lower member 14 has a front and back wall 14C and 14D extending between the open ends 14A and 14B such as to form a chamber 14E. The upper member 12 preferably has only a back wall 12C extending between the ends 12A and 12B. The members 12 and 14 are preferably telescopingly mounted such that the bottom end 12B of the upper member 12 slides over the top end 14A of the lower member 14 with the back wall 12C of the upper member 12 adjacent the back wall 14D of the lower member 14. In the preferred embodiment, the upper and lower members 12 and 14 form one of the legs 104 of the work station 100 or table (FIG. 1). The top end 12A of the upper member 12 is preferably provided with a bracket 16 which allows for mounting the apparatus 10 on the underneath surface 102A of the work surface 102. However, any means of fastening the apparatus 10 to the work surface 102 can be used. The bottom end 14B of the lower member 14 is preferably provided with a foot piece 18 which creates a larger foot print for the leg 104 to provide more stability to the work station 100. In a work station 100 having two legs 104, the apparatus 10 can be used in one leg 104 or in both legs 104 (FIG. 1). Regardless of whether both legs 104 contain an apparatus 10, the legs 104 are connected together to ensure that both legs 104 move at the same rate. In an alternate embodiment (not shown), a single apparatus 10 is used in a center single leg of a table.

Figure 4:
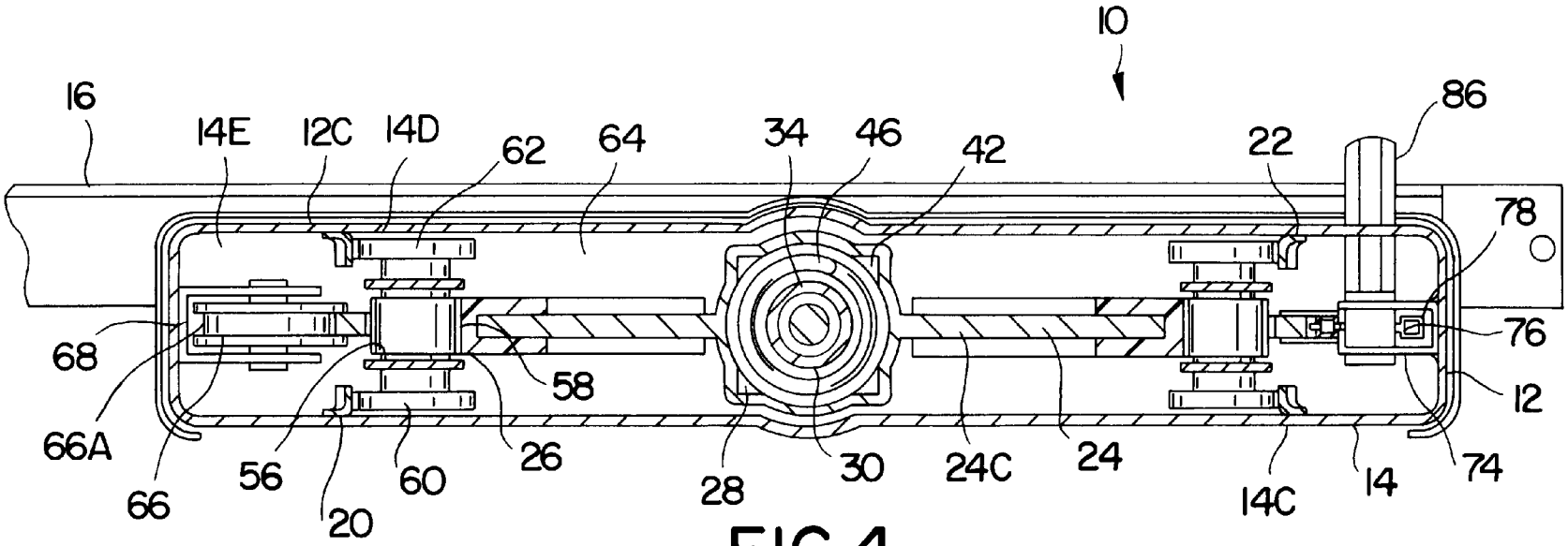
FIG. 4 is a top cross-sectional view along the line 4—4 of FIG. 2 of the counterbalance apparatus 10 showing the cam followers 56, the inner cam surfaces 26 and the front and back cam surfaces 20 and 22.

In the preferred embodiment, both the front wall 14C and the back wall 14D of the lower member 14 are provided with a pair of inclined, front and back outer cam surfaces 20 and 22 (FIG. 4). However, the apparatus 10 could also be provided with one pair of outer cam surfaces 20 or 22 either on the front wall 14C or the back wall 14D or one on each wall 14C or 14D equalling a single pair. The cam surfaces 20 and 22 are mounted on the inner surfaces of the front and back walls 14C and 14D of the lower member 14 such that the front and back outer cam surfaces 20 and 22 are within the chamber 14E of the lower member 14. The front and back outer cam surfaces 20 and 22 are parallel and spaced apart and located at the same position on their respective walls 14C or 14D. The pair of front outer cam surfaces 20 are identical to the pair of back outer cam surfaces 22. The pairs of outer cam surfaces 20 and 22 are mounted such that the cam surfaces of each pair of cam surfaces 20 and 22 are mirror images of each other and are located on opposite sides of the longitudinal axis A—A of the apparatus 10 (FIG. 2). The mounting of each cam surface of each pair of cam surfaces 20 and 22 on each side of the axis A—A of the apparatus 10 enables the lateral forces acting on one cam surface of one pair to cancel the lateral forces acting on the other cam surface of the same pair. Thus lateral movement of the center member 24 is prevented as the center member 24 moves up and down. The outer cam surfaces 20 and 22 are uniformly inclined with respect to the longitudinal axis A—A such that the slope and the curve representing the inclination of the cam surfaces 20 and 22 is linear. The outer cam surfaces 20 and 22 are mounted such that as the cam surfaces 20 and 22 extend down toward the bottom of the apparatus 10, the cam surfaces 20 and 22 angle inward toward each other. Thus, the top ends of the cam surfaces 20 and 22 are spaced apart farther from the vertical axis A—A of the apparatus 10 than the bottom ends of the cam surfaces 20 and 22 (FIG. 2). In the preferred embodiment, the cam surfaces 20 and 22 are preferably mounted by welding onto the inner surfaces of the front and back walls 14C and 14D of the lower members 14. However, any well known means of fastening the cam surfaces 20 and 22 on the walls 14C and 14D of the lower member 14 can be used.

Figure 3:
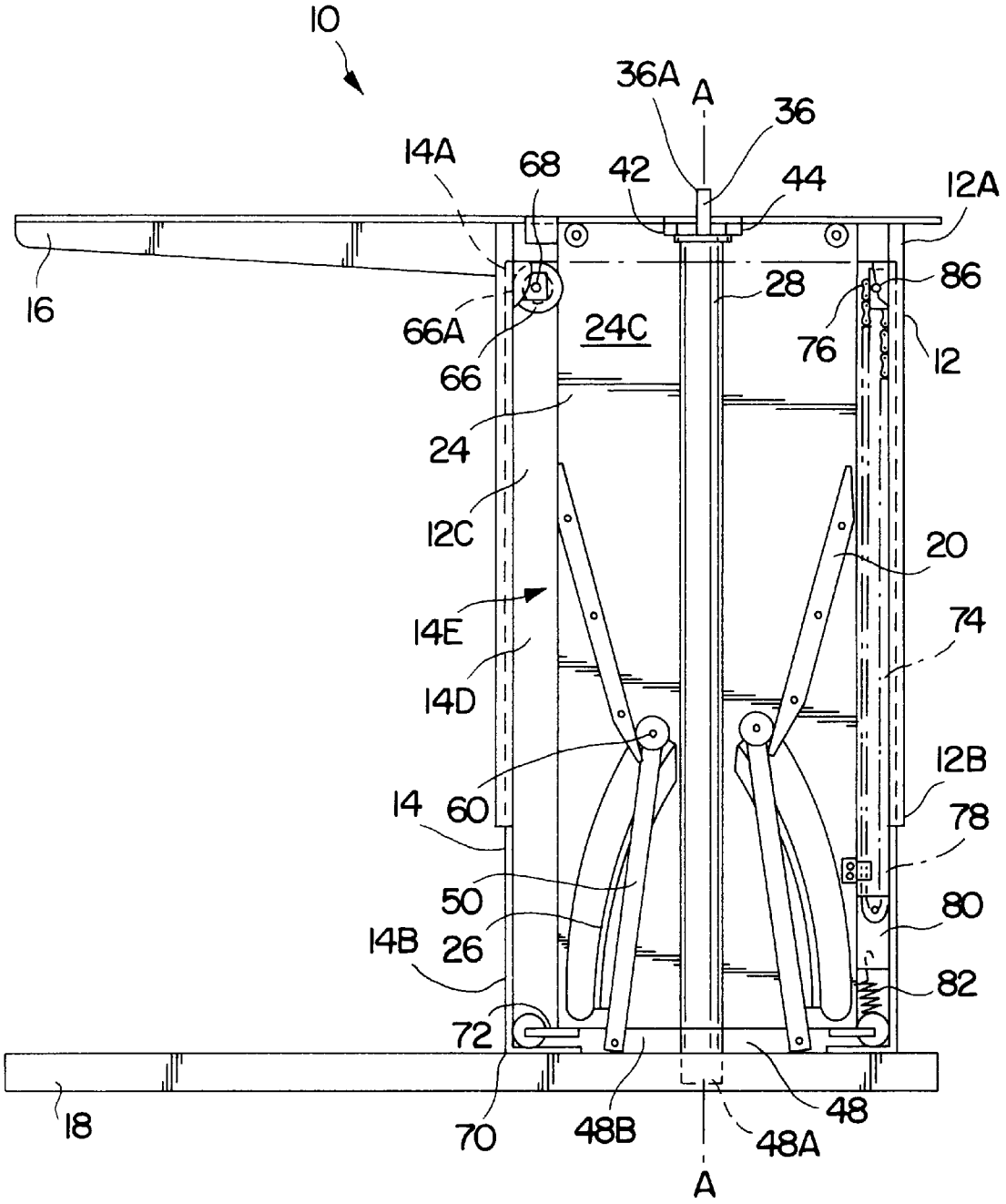
FIG. 3 is a side view of the counterbalance apparatus 10 without the front wall 14C of the lower member 14 in the fully lowered position.

The center member 24 preferably has a generally rectangular shape with a top end 24A, a bottom end 24B and a wall 24C extending therebetween. The top end 24A of the center member 24 is preferably connected to the top end 12A of the upper member 12 (FIGS. 2 and 3). The top end 24A of the center member 24 is mounted on the upper member 12 such that the center member 24 is spaced apart from the back wall 12C of the upper member 12. The bottom end 24B of the center member 24 preferably extends into the open top end 14A and into the chamber 14E of the lower member 14. The top end 14A of the lower member 14 is preferably provided with a cover 64 which allows the center member 24 to slide in and out of the chamber 14E of the lower member 14 but prevents dirt and other debris from entering the chamber 14E of the lower member 14 and possibly jamming or damaging the apparatus 10. The wall 24C of the center member 24 is provided with a pair of curved, inner cam surfaces 26. The inner cam surfaces 26 preferably form openings in the wall 24C of the center member 24. The cam surfaces 26 are preferably adjacent to the bottom end 24B of the center member 24. The cam surfaces 26 of the pair of cam surfaces 26 are positioned on opposite sides of the longitudinal axis A—A of the apparatus 10 and are mirror images of each other. The mounting of each cam surface of the pair of cam surfaces 24 on each side of the axis A—A of the apparatus 10 enables the lateral forces acting on one cam surface to cancel the lateral forces acting on the other cam surface. Thus lateral movement of the center member 24 is prevented as the center member 24 moves up and down. The inner cam surfaces 26 preferably do not have a uniform angle. The exact angle of the inner cam surfaces 26 is preferably dependent on the force storage mechanism or spring 46 and 47 (to be described in detail hereinafter).

The inner and outer cam surfaces 20, 22 and 26 can be made of metal or other materials and can be coated with a non-stick, low friction material. The material used to construct the cam surfaces 20, 22 and 26 depends in part upon the construction of the cam followers 56 (to be described in detail hereinafter). In the preferred embodiment, the inner cam surfaces 26 and outer cam surfaces 20 and 22 are provided with a nylon layer which reduces the noise of the apparatus 10 during use. Preferably, the contact between the cam surfaces 20, 22 and 26 and the cam rollers 58, 60 and 62 of the cam followers 56 is as low friction as possible such that a majority of the applied force is used to move the work surface 102 up and down.

A cylindrical center chamber 28 extends the entire length of the center member 24 along the vertical axis A—A of the apparatus 10. The center chamber 28 of the center member 24 houses the damper cylinder or safety cylinder 30, the force storage mechanism or coil springs 46 and 47 and the threaded adjustment rod 36.

Figure 9:
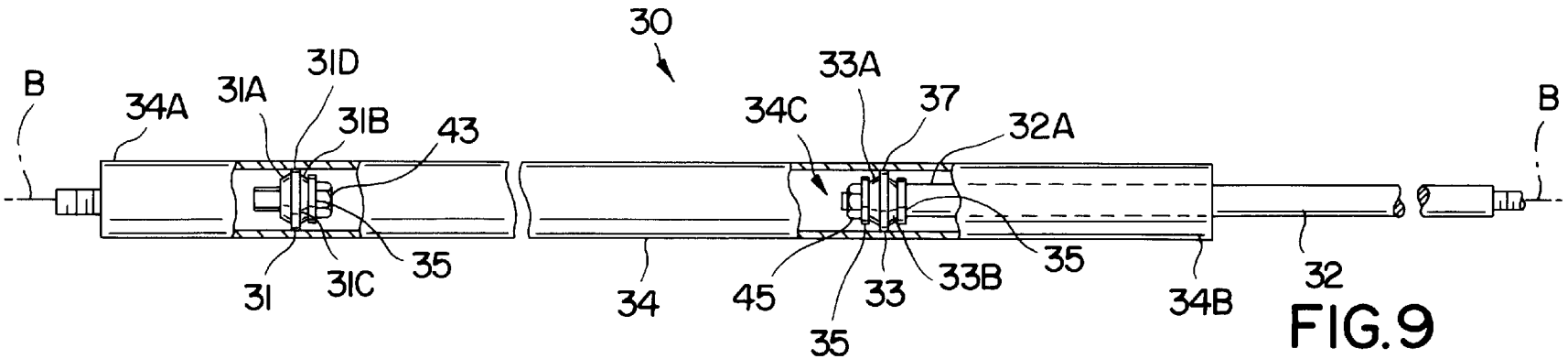
FIG. 9 is a front cross-sectional view of the safety cylinder 30 showing the lower piston member 33 on the end of the rod 32 and the upper piston member 31 within the chamber 34C of the barrel 34.
Figure 11:
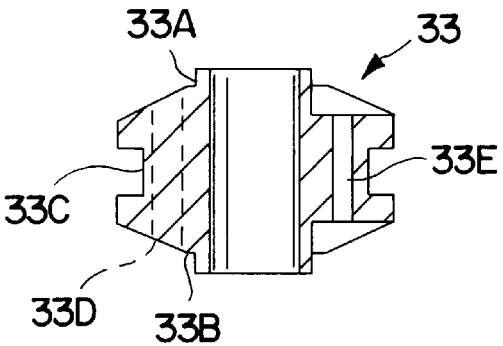
FIG. 11 is a cross-sectional view of the lower piston member 33 showing the bypass orifice 33D and the restriction orifice 33E.
Figure 10:
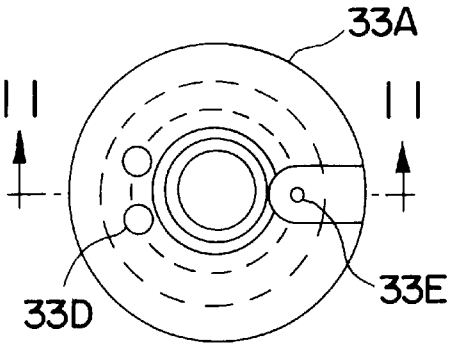
FIG. 10 is a top view of the lower piston member 33.

In the preferred embodiment, the damper cylinder 30 includes a barrel 34, a rod 32 and a lower piston member 33 mounted on the end 32A of the rod 32 and an upper piston member 31 (FIG. 9). The damper cylinder 30 is preferably a dual velocity damper having two restriction speeds or velocities. The barrel 34 has an upper and lower end 34A and 34B with an inner chamber 34C extending therebetween. The barrel 34 and chamber 34C preferably have a cylindrical shape. The upper end 34A of the barrel 34 is preferably sealed. The lower end 34B of the barrel 34 preferably has an opening through which the rod 32 is inserted. The upper piston member 31 preferably has an upper end 31A and a lower end 31B with a cylindrical center portion 31C therebetween. The cylindrical center portion 31C of the upper piston member 31 is preferably fixably fastened to the inner sidewall of the barrel 34. In the preferred embodiment, the center portion 31C of the upper piston member 31 has a protrusion 31D around the circumference. The protrusion 31D fits with detents provided on the inner sidewall of the barrel 34. The ends 31A and 31B of the upper piston member 31 are preferably similar and have a truncated conical shape with the truncated apex of the end extending outwards away from the center portion 31C of the piston member 31. The upper piston member 31 is provided with a bypass orifice (not shown) extending completely through the upper piston member 31 parallel to the axis B—B of the cylinder 30. The upper piston member 31 can have several bypass orifices. In the preferred embodiment, the upper piston member 31 has 2 bypass orifices. A seal 35 is mounted adjacent the lower end 31B of the upper piston member 31. The seal 35 is of such a size that when a force of fluid in the chamber is greater than a predetermined amount, the seal 35 will deform or flex and close the by pass orifices in the upper piston member 31. A nut 43 and screw (not shown) are used to fasten the seal 35 adjacent the lower end 31B of the upper piston member 31. An other means of fastening the seal 35 on the piston member 31 can also be used. The lower piston member 33 is preferably similar in shape to the upper piston member 31 with an upper end 33A, a lower end 33B and a cylindrical center portion 33C therebetween. The ends 33A and 33B of the lower piston member 33 also have a truncated conical shape with the truncated apex extending outward away from the center portion 33C of the piston member 33. The lower piston member 33 has a center opening through when the end 32A of the rod 32 is inserted for mounting the lower piston member 33 on the rod 32. The lower piston member 33 is preferably secured on the end 32A of the rod 32 by a nut 45. An other means of fastening the piston member 33 on the rod 32 can also be used. The center portion 33C has a concentric groove within which is mounted a sealing o-ring 37. The o-ring 37 preferably has an outer diameter slightly larger in size than the inner diameter of the barrel 34 of the cylinder 30 such that the o-ring 37 forms a seal 35 between the lower piston member 33 and the inner sidewall of the barrel 34 as the lower piston member 33 is moved within the barrel 34. The piston member 33 preferably has a pair of bypass orifices 33D and a restriction orifice 33E extending completely through the piston member 33, parallel to the rod 32 (FIGS. 10 and 11). The bypass orifices 33D are preferably located in half of the piston member 33 and the restriction orifice 33E is preferably located in the other half of the member separated by the rod 32. The bypass orifices 33D preferably have a larger diameter than the restriction orifice 33E. In the preferred embodiment, the ends 33A and 33B of the piston member 33 are provided with a notch around the restriction orifice 33E (FIG. 10). A pair of seals 35 are mounted adjacent each end of the piston member 33. The seals 35 are of such a size that when the fluid pressure pushing on the seal 35 exceeds a certain amount, the seal 35 flexes to close off the bypass orifice 33D, which seal 35 deforms depends on the direction of movement of the piston member 33. The piston member 33 is preferably constructed of a non-deformatable material such as aluminum. The seals 35 are constructed of a flexible material such as rubber. The chamber 34C of the barrel 34 contains a hydraulic fluid and air.

Figure 5:
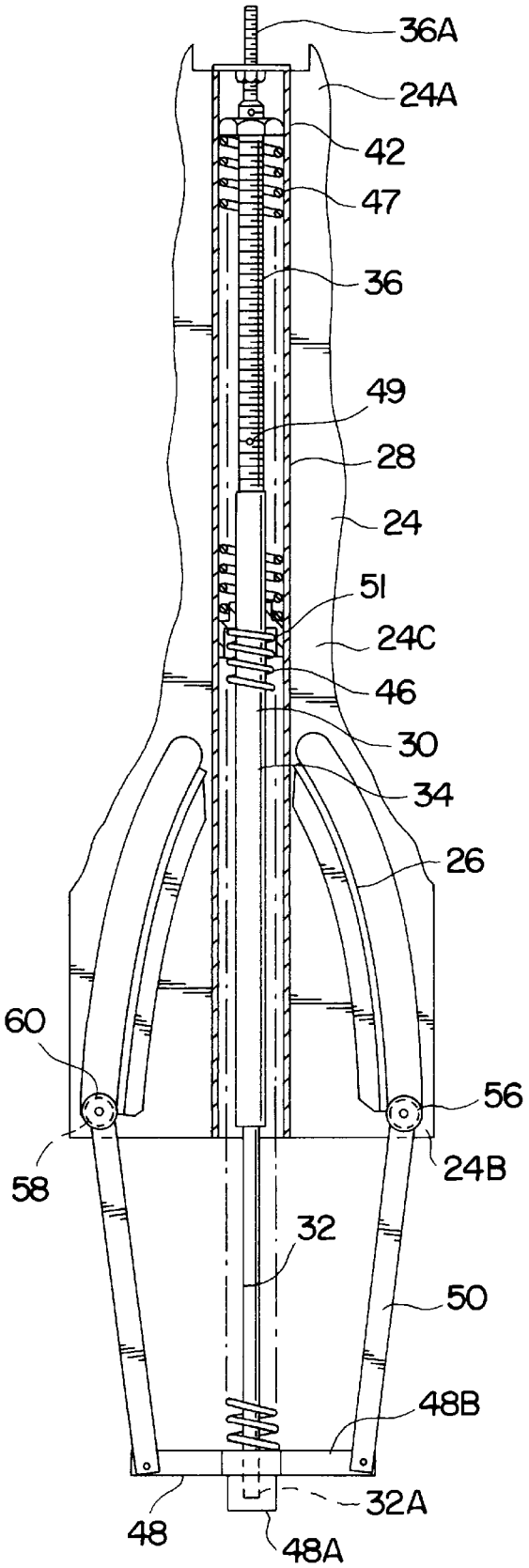
FIG. 5 is a partial view of the counterbalance apparatus 10 showing only the inner cam surfaces 26, the cylinder 30 and the adjustment rod 36.

The damper cylinder 30 is mounted in the center chamber 28 of the center member 24 such as to extend from about the middle of the wall 24C of the center member 24 to below the bottom end 24B of the center member 24 (FIG. 5). The damper cylinder 30 is mounted such that the rod 32 of the cylinder 30 extends downward beyond the bottom end 24B of the wall 24C of the center member 24 and the barrel 34 of the damper cylinder 30 is located within the center chamber 28 of the center member 24. In the alternate embodiment having two counterbalance apparatus 10, preferably only one of the counterbalance apparatus 10 includes the damper cylinder 30. The other counterbalance apparatus 10 preferably includes a slave cylinder (not shown) having no dampening properties. The damper cylinder 30 in only one apparatus 10 provides sufficient dampening to reduce the rate of the movement of the work surface 102. The end 32A of the rod 32 opposite the barrel 34 is preferably mounted through the center circular socket 48A of a winged bracket 48. The winged bracket 48 preferably has a center circular socket 48A for holding the end 32A of the rod 32 of the damper cylinder 30 and the bottom end of the lower spring 46 (to be described in detail hereinafter). The rod 32 is secured in the bracket 48 by a nut (not shown).

A threaded adjustment rod 36 is mounted on the top end of the barrel 34 (FIG. 5), opposite the rod 32. An adjustment nut 42 is threadably mounted on the threaded, outer surface of the adjustment rod 36. The threaded adjustment rod 36 extends upward from the damper 30 such that the top end 36A of the threaded rod 36, opposite the barrel 34 of the damper 30, is adjacent the top end 24A of the center member 24 and extends through an opening (not shown) in the end of the center member 24 and through an opening (not shown) in the work surface 102. Preferably, when the apparatus 10 is correctly mounted on the work station 100, the top end 36A of the threaded rod 36 is slightly below the top surface of the work surface 102 (FIG. 1). Preferably, the opening in the work surface 102 is slightly larger than the diameter of the threaded rod 36 such that an adjustment handle 40 can be mounted over the end 36A of the threaded rod 36 to rotate the rod 36 (FIG. 1) to allow adjustment of the preload force on the coil springs 46 and 47. A stopper 49 is provided on the threaded adjustment rod 36 to limit the movement of the adjustment nut 42 and consequently the maximum amount of compression of the springs 46 and 47.

In the embodiment having two counterbalance apparatus 10, one in each leg 104, the top end 36A of the threaded rod 36 below the top surface of the work surface 102 and above the adjustment nut 42 is provided with an adjustment sprocket 44 (FIG. 1). The sprocket 44 is attached by a chain or belt 38 to an identical sprocket 44 located on the adjustment rod (not shown) of the apparatus (not shown) in the opposite leg 104. The connection of the adjustment rods 36 of the apparatuses 10 ensures that the preload force on the springs 46 and 47 in each apparatus 10 is the same.

The coil springs 46 and 47 preferably extend the entire length of the damper cylinder 30 and the adjustment rod 36.

Figure 12:
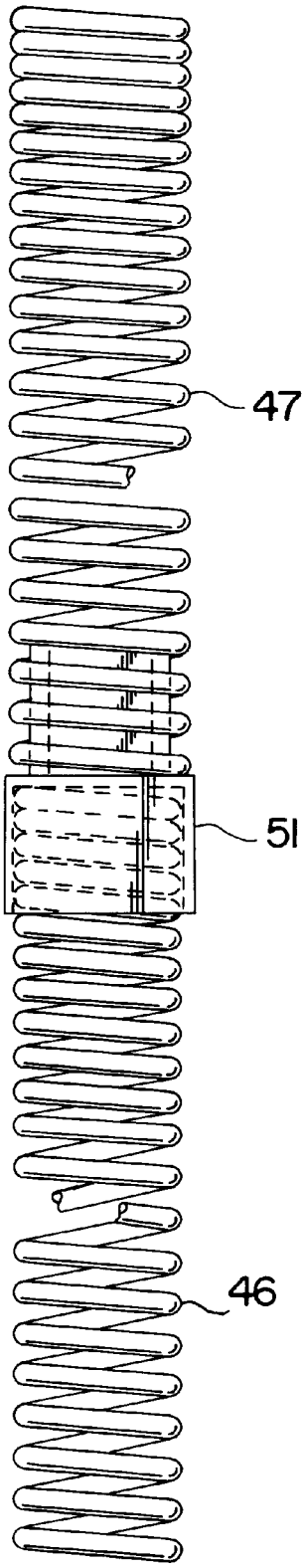
FIG. 12 is a front view of the springs 46 and 47 connected together by the bushing 51.

Thus, the springs 46 and 47 extend from the top end 24A of the center member 24 to the center socket 48A of the winged bracket 48. The springs 46 and 47 are preferably formed by two separate springs 46 and 47 which allow for the correct production of force (FIG. 12). However, any multiple of springs could be used as necessary to provide the correct variable spring force. The stronger, lower spring 46 is preferably spaced below the smaller, weaker upper spring 47 adjacent the winged bracket 48. In the preferred embodiment, the springs 46 and 47 are connected end to end by a bushing 51 (FIG. 12) which allows the springs 46 and 47 to act in unison as a single spring. The top of the upper spring 47 preferably is abutted against the adjustment nut 42 located on the top end 36A of the adjustment rod 36. The lower end of the stronger, lower spring 46 extends into the center socket 48A of the winged bracket 48 and abuts against a stopper (not shown) in the center socket 48A of the winged bracket 48.

The winged bracket 48 preferably has a pair of parallel, spaced apart arms 48B extending outward from each side of the socket 48A. Front and back connector arms 50 (one shown) are pivotably connected at one end to the ends of the pairs of arms 48B opposite the socket 48A. The other ends of the front and back connector arms 50 are pivotably connected to the cam followers 56 adjacent the front and back outer cam rollers 60 and 62. The connector arms 50 transfer the force of the springs 46 and 47 to the cam followers 56. The connector arms 50 also prevent side by side movement of the center. member 24 and prevent the center member 24 from tilting and jamming by keeping the center member 24 vertical.

The pair of cam followers 56 are preferably constructed of inner rollers 58 and outer rollers 60 and 62 rotatably mounted together on an axle (not shown). The cam followers 56 are preferably identical. The cam followers 56 are mounted on the connector arms 50 such that the axle of the cam followers 56 is perpendicular to the longitudinal axis A—A of the apparatus 10. The inner rollers 58 move along the inner cam surfaces 26 and the outer cam rollers 60 and 62 move along the outer cam surfaces 20 and 22. In the preferred embodiment, there are front outer rollers 60 and back outer rollers 62. If only one outer cam surface pair 20 or 22 is used, then only one outer cam roller 60 or 62 is needed. The rollers 58, 60 and 62 are preferably positioned in the cam followers 56 such that the inner rollers 58 are spaced between outer rollers 60 and 62. The outer rollers 60 and 62 are preferably spaced apart from the inner rollers 58 to enable the rollers 60 and 62 to engage the outer cam surfaces 20 and 22 on the front and back walls 14C and 14D of the lower member 14. The outer rollers 60 and 62 are spaced apart from the inner rollers 58 a distance equal to the space between the inner cam surfaces 26 and the outer cam surfaces 20 and 22. The rollers 58, 60 and 62 are preferably discs or wheels which easily rotate about the axle. The construction of the rollers 58, 60 and 62 depends upon the construction of the cam surfaces 20 and 22. The rollers 58, 60 and 62 are preferably constructed such as to minimize friction between the rollers 58, 60 and 62 and the cam surfaces 20, 22 and 26. The inner cam roller 58 is preferably constructed of a single disc which rotates and rolls along the inner cam surface 26. The inner cam roller 58 can also be constructed of multiple discs. The rollers 58, 60 and 62 adjacent the axle are preferably provided with ball bearings (not shown) to allow for easier rotation and to reduce the amount of friction in the apparatus 10.

In the preferred embodiment, rollers 66 are provided along the sides of the lower member 14 in the chamber 14E. The rollers 66 are preferably mounted by brackets 68 to the side walls of the lower member 14 and extend inward and into contact with the sides of the center member 24. The rollers 66 preferably have a groove 66A within which the side of the center member 24 rides. The center member 24 is also preferably provided with rollers 70 which are mounted by brackets 72 to the sides of the center member 24 at the bottom end 24B. The rollers 70 extend outward from the center member 24 and into contact with the sides of the lower member 14. The rollers 66 and 70 assist in the sliding movement of the center member 24 in and out of the lower member 14.

An alignment mechanism 74 is mounted in the chamber 14E of the lower member 14 and assists in coordinating the two legs 104 of the work station 100 during raising and lowering of the work surface 102 (FIG. 1). The alignment mechanism 74 includes a sprocket 76, a chain 78 and a tensioning bracket 80. The sprocket 76 is preferably located adjacent the top end 14A of the lower member 14. The chain 78 extends around the sprocket 76 and through the lower tensioning bracket 80 to create a continuous loop. The tensioning bracket 80 is preferably mounted by a spring 82 to the bottom of the lower member 14. The bracket 80 has a center sprocket 84 which rotates and allows the chain 78 to easily move through the bracket 80. The chain 78 is preferably securely and immovably connected to the side of the center member 24. Thus, as the center member 24 moves, the chain 78 also moves which causes the sprocket 76 to rotate. The sprocket 76 is mounted to one end of an alignment rod 86 which extends outward perpendicular to the longitudinal axis A—A of the apparatus 10 (FIG. 1). In the preferred embodiment, the alignment rod 86 is constructed of a center rod (not shown) which is connected at each end to a second rod (not shown) connected to the sprocket 76 of each apparatus 10. The rotating rod 86 extending between the apparatuses 10 ensures that the apparatuses 10 act in unison during raising and lowering the work surface 102. The alignment rod 86 also distributes the load on the work surface 102 between the two counterbalance apparatuses 10. Therefore, if the load on the work surface 102 is not distributed evenly on the work surface 102, the rod 86 ensures that the apparatuses 10 operate as a single unit to lift and lower the load. Therefore, the rod 86 compensates for offset loads. In the alternate embodiment, with only one apparatus 10 but having two legs 104, the rotating rod 86 ensures that the legs 104 of the work station 100 raise and lower in unison.

A spring wrap brake 90 is mounted around the center of the rod 86 (FIG. 1). The spring wrap brake 90 is preferably activated by the user to allow the apparatuses or apparatus 10 to be used to raise and lower the work surface 102. The spring wrap brake 90 is preferably similar to those well known in the art. A hand activated release lever 92 is preferably mounted on the underneath surface 102A of the work surface 102 and allows the user to disengage the brake 90 to allow for raising and lowering of the work surface 102 (FIG. 1), pulling the lever 92 opening up the spring coils of the spring wrap brake 90 around the rod 86 which allows the rod 86 to rotate. In the preferred embodiment, the brake 90 allows the work surface 102 to be raised but does not allow lowering of the work surface 102 without deactivation of the brake 90.

An electric motor (not shown) can be connected to the rod 86 to allow automated raising and lowering of the work surface 102. Use of an electric motor allows a user to raise and lower the work surface 102 without exerting any force. The electric motor can be connected to the rod 86 by a belt and pulley system (not shown), a series of gears or any other well known mechanical linkage method. Due to the use of the counterbalance apparatus 10, the horsepower of the electric motor used to raise and lower the work surface 102 can be relatively small such as 0.01 horsepower.

In Use

The apparatus 10 of the present invention is used to raise or lower a work surface 102 of a work station 100. Preferably, a load (not shown) such as a computer or typewriter, etc. is located on the work surface 102. The operation to raise the work surface 102 is identical but opposite from the operation to lower the work surface 102. To begin, the user must first select the apparatus 10 which is correct for the application. The springs 46 and 47 of the apparatus 10 are selected based upon the range of load on the work surface 102. The springs 46 and 47 preferably are non-constant and change their force output at a constant, compound rate. The springs 46 and 47 are preferably defined by the equation:

$$F=F_o\times e^{-KY}$$

where F is the force exerted by the springs 46 and 47, $F_o$ is the initial preload force on the springs 46 and 47 which holds the work surface 102 in a raised position with no load on the work surface 102. The initial preload force ($F_o$) is preferably equal to the amount of force pushing down on the apparatus 10 by the work surface 102. Preferably, in the initial position with the apparatus 10 fully extended, the springs 46 and 47 are not fully extended. Preferably, the springs 46 and 47 are compressed to provide the initial preload force ($F_o$). K is the constant defining the compound rate of change of the spring rate of combined springs 46 and 47 and Y is the displacement or the compression distance of the springs 46 and 47 along the longitudinal axis A—A of the apparatus 10. The displacement of the springs 46 and 47 is preferably calculated from a starting point of zero (0) which represents the length of the springs 46 and 47 when the cam followers 56 are at the bottom of the inner cam surfaces 26 and the apparatus 10 is in the fully extended position. Y is preferably always a negative number. Preferably, there is a constant relationship between the force exerted by the springs 46 and 47 (F) and the instantaneous spring constant $\Delta F/\Delta Y$ such that $F/(\Delta F/\Delta Y)$ remains constant throughout the compression of the springs 46 and 47. Once the springs 46 and 47 are selected, the slope of the inner cam surfaces 26 is determined using the equation:

$$\frac{X}{Z}=\frac{\left(Y-\frac{1}{K}[1-e^{-KY}]\right)}{M}$$

where X is the displacement of the inner cam rollers 58 along the inner cam surfaces 26, M is the slope of the line representative of the outer cam surfaces 20 and 22. The curve of the inner cam surfaces 26 is preferably non-linear. The angle of the inner cam surfaces 26 varies to compensate for the change in spring rate of the springs 46 and 47. The outer cam surfaces 20 and 22 are linear and share the force of the springs 46 and 47 with the inner cam surfaces 26 and compensate for the adjusted preload force or constant portion of the force applied to the apparatus 10. The adjusted preload force is the initial preload force ($F_o$) which is necessary to hold up the work surface 102 plus the force which is necessary to compensate for the load on the work surface 102. The range of load on the work surface 102 is used to determine the adjusted preload force applied to the apparatus 10. Changing the range of adjusted preload force could require changing the springs 46 and 47 and the curve of the inner cam surfaces 26. The length of the inner cam surfaces 26 represents the compression of the springs 46 and 47 as a result of the movement of the members 12 and 24 of the apparatus 10 or the distance traveled by the work surface 102. The compression of the springs 46 and 47 as a result of the initial preload force ($F_o$) is separate from the compression the springs 46 and 47 as a result of the stroke of the apparatus 10. Therefore, the total compression of the springs 46 and 47 is equal to the preload compression plus the compression of the springs 46 and 47 as a result of the travel of the apparatus 10. The outer cam surfaces 20 and 22 allow the work surface 102 to travel an additional distance beyond the distance resulting from compression of the springs 46 and 47. The length of the inner cam surfaces 26 and the length of the outer cam surfaces 20 and 22 provide for the total amount of distance traveled by the work surface 102.

The choice of springs 46 and 47 and inner and outer cam surfaces 20 and 22 allows for a constant force to be acting on the work surface 102 by the apparatus 10 throughout the entire movement of the work surface 102 for any adjusted preload force within the range. Once the springs 46 and 47 and inner and outer cam surfaces 20 and 22 are selected, the apparatus 10 is assembled and mounted onto the work station 100.

Figure 6:
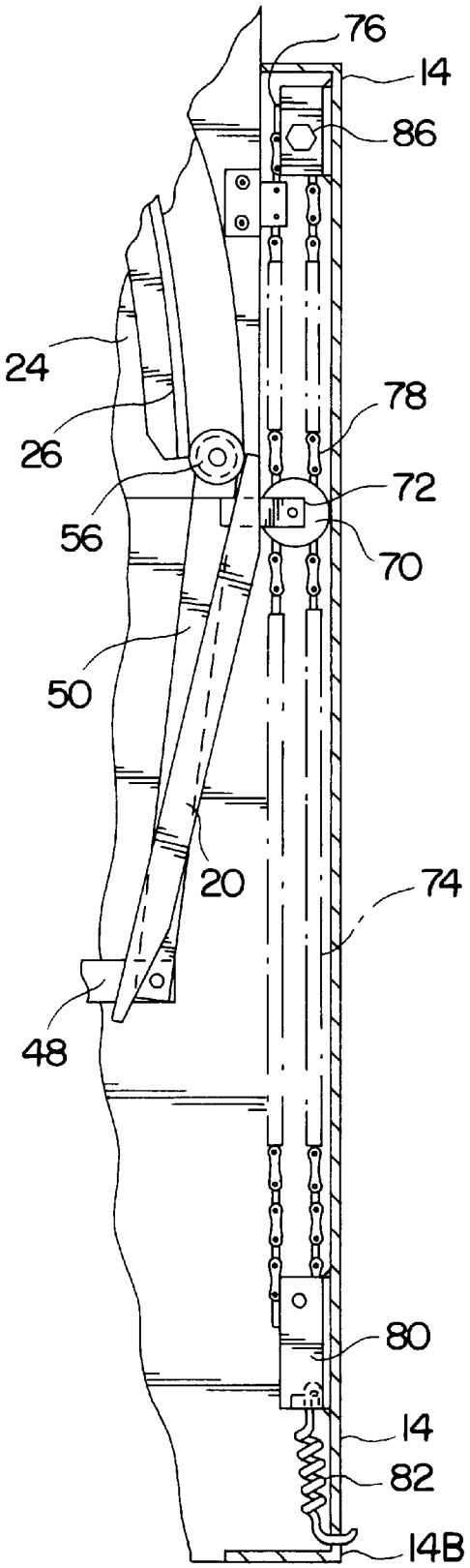
FIG. 6 is a partial cross-sectional view of the counterbalance apparatus 10 showing the alignment chain 78.

The apparatus 10 is mounted to the underneath surface 102A of the work surface 102 of the work station 100 by the bracket 16 attached to the top end 12A of the upper member 12. The top end 24A of the center member 24 is mounted on the top end 12A of the upper member 12 which is mounted to the underside 102A of the work surface 102 such that the adjustment head of the adjustment rod 36 extends upward through the opening in the work surface 102 (FIG. 1). The adjustment handle 40 is attached onto the adjustment head and is rotated until the initial tension or adjusted preload force on the springs 46 and 47 is correct for the weight of the work surface 102, any load on the work station 100 and any additional weight caused by the apparatus 10. Rotation of the adjustment rod 36 allows the distance between the adjustment nut 42 and the bracket 48 to be varied to change the adjusted preload force on the spring 46 (FIG. 6). As the threaded rod 36 is rotated, the adjustment nut 42 moves up or down the threaded rod 36 along the longitudinal axis A—A of the apparatus 10 depending upon the direction of rotation of the threaded rod 36. As the adjustment nut 42 moves along the threaded adjustment rod 36, the springs 46 and 47 are compressed or decompressed. The greater the load on the work surface 102, the greater the compression of the springs 46 and 47. The weaker, upper spring 47 compresses at a faster rate than the stronger, lower spring 46. Once the apparatus 10 is properly installed and the adjusted preload force is correctly set, the forces exerted on the work surface 102 are in equilibrium which allows the work surface 102 to be easily moved up or down in a vertical direction.

To move the work surface 102, the user releases the brake 90 by moving the lever 92. In the preferred embodiment, the brake 90 only needs to be released to lower the work surface 102. The user then exerts a small force on the work surface 102 in the direction the work surface 102 is to be moved. During vertical movement of the work surface 102, the center member 24 telescopes in and out of the lower member 14. In the fully compressed or lowered position, with the work surface 102 in the lowermost position, the center member 24 is almost fully within the lower member 14 and the springs 46 and 47 and damper 30 are in the compressed position (FIG. 3). As the work surface 102 is moved vertically upward, the center member 24 is lifted upward, out of the lower member 14. To raise the work surface 102, the user exerts an upward force on the work surface 102 which moves the upper and lower members 12 and 24 of the apparatus 10 apart, expanding the springs 46 and 47 and moving the inner and outer cam rollers 58, 60 and 62 along the inner and outer cam surfaces 20, 22 and 26, respectively.

As the center member 24 is moved up or down, the connector arms 50 connected to the winged bracket 48 move the cam followers 56 in response to compression and expansion of the springs 46 and 47. The pairs of cam rollers 58, 60 and 62 on the cam followers 56 rotate within and follow along the cam surfaces 20, 22 and 26. In the initial compressed position, the cam followers 56 are located at the bottom most point of the outer cam surfaces 20 and 22 and at the top most point of the inner cam surfaces 26. As the center member 24 is lifted upward, the inner cam surfaces 26 begin to move upward away from the outer cam surfaces 20 and 22. The outer cam rollers 60 and 62 follow the outer cam surfaces 20 and 22 upward toward the top of the outer cam surfaces 20 and 22 at the same time as the inner cam rollers 58 follow the inner cam surfaces 26 downward toward the bottom of the inner cam surfaces 26. As the cam rollers 58, 60 and 62 move along the surfaces 20, 22 and 26, the cam rollers 58, 60 and 62 rotate about their axises perpendicular to the axis A—A of the apparatus 10 to allow for easier travel of the cam rollers 58, 60 and 62 on the surfaces 20, 22 and 26. As the springs 46 and 47 expand, the springs 46 and 47 exert an upward force toward the work surface 102. In response to the upward force on the springs 46 and 47, the inner cam surfaces 26 exert an upward force on the inner cam rollers 58 and the outer cam surfaces 20 and 22 exert an upward force on the outer cam rollers 60 and 62. The inner and outer cam rollers 58, 60 and 62 travel on the inner and outer cam surfaces 26, 20 and 22 such that the cam surfaces 26, 20 and 22 share the force of the springs 46 and 47. The inner cam rollers 58 move along the inner cam surfaces 26 to counteract the changing force of the springs 46 and 47, so as to allow the work surface 102 to be raised and lowered with a constant force. The outer cam rollers 60 and 62 of the cam followers 56 move along the outer cam surfaces 20 and 22 in the lower member 14 carrying a constant force to counteract the constant adjusted preload force. In addition, the outer cam surfaces 20 and 22 provide the additional distance of movement of the work surface 102 not provided by the springs 46 and 47. The inner cam surfaces 26 allow the force exerted on the work surface 102 to remain constant by varying the force normal to the inner cam rollers 58 to compensate for the varying force exerted by the springs 46 and 47 resulting from the compression of the springs 46 and 47. The normal force exerted on the inner cam rollers 58 changes direction to compensate for the change in force exerted by the springs 46 and 47. The inner cam rollers 58 of the cam followers 56 move along the inner cam surfaces 26 in the center member 24 to compensate for the changing force of the springs 46 and 47 to provide a constant force output. Each of the inner cam surfaces 26 preferably carry or compensate for one half of the increasing force of the springs 46 and 47 beyond the initial preload force ($F_o$). The slope of the curve of the inner cam surfaces 26 is directly related to the slope of the curve of the non-constant springs 46 and 47. The interaction of the springs 46 and 47 and the inner cam rollers 58 allows for a constant force acting on the work surface 102 along the entire length of movement of the work surface 102. The non-linear curve of the inner cam surfaces 26 creates a camming action between the inner cam rollers 58 and the inner cam surfaces 26 which varies the normal force exerted on the cam rollers 58 by the cam surfaces 20 and 22. As the rollers 58 move along the surfaces 26, the normal force on the inner cam rollers 58 varies to compensate for the increasing force exerted by the springs 46 and 47 to provide a constant force acting on the work surface 102. Preferably, this is true once the preload adjustment is made, regardless of the weight of the load on the work surface 102. The relationship between the springs 46 and 47 and the inner cam surfaces 26 allows the outer cam surfaces 20 and 22 to have a linear slope and a constant force. Preferably, as the springs 46 and 47 are compressed, the inner cam surfaces 26 take an increasing share of the force of the springs 46 and 47 while the outer cam surfaces 20 and 22 carry a constant share of the force giving the constant output force for lifting the work surface 102.

When lifting the work surface 102, the force of the springs 46 and 47 pushing upward assists the lifting force of the user to allow the user to lift a work surface 102 having a greater weight by exerting a relatively small force. In addition, the downward force of the inner cam surfaces 26 on the inner cam rollers 58 works against the upward force of the springs 46 and 47 such that the force exerted on the work surface 102 remains constant throughout the complete movement of the work surface 102. The force on the cam rollers 58 and consequently, the cam surfaces 26, changes as the compression of the springs 46 and 47 is changed. The greater the compression of the springs 46 and 47, the greater the load on the cam surfaces 26. The cam rollers 58 travel along the inner side of the cam surfaces 26 which allows the cam surfaces 26 to carry a greater part of the force of the springs 46 and 47. The force on the outer cam rollers 60 and 62 and consequently, the outer cam surfaces 20 and 22 remains constant throughout the entire movement of the work surface 102 and compensates for the adjusted preload force on the springs 46 and 47.

As the work surface 102 moves upward and the springs 46 and 47 expand, the rod 36 of the cylinder damper 30 is extended out of the barrel 34 of the cylinder damper 30. The damper 30 reduces the rate of ascent and descent of the work surface 102, if the rate exceeds a preset limit. The damper 30 preferably exerts no upward or downward force on the apparatus 10 or the work surface 102 when the apparatus 10 is not moving. Preferably, during normal operation of the apparatus 10, the damper 30 exerts only a negligible force when the apparatus 10 is moving. However, as the speed of movement increases beyond a predetermined speed, the damper 30 exerts a force in the direction opposite of the movement increase. In the initial position of unrestricted or minimum restriction flow, the bypass and restriction orifices 33D and 33E on the upper and lower piston members 31 and 33 are open allowing unrestricted flow of the fluid as the rod 32 and lower piston member 33 are moved inside the barrel 34. When the velocity or speed of the work surface 102 and consequently, the rod 32 and lower piston member 33 of the damper cylinder 30 exceed a preset limit, the force of the hydraulic fluid in the barrel 34 adjacent the seals 39 adjacent the upper or lower end 33A or 33B of the lower piston member 33 forces the seals 39 against the upper or lower end 33A or 33B of the lower piston member 33 and consequently, closing off the bypass orifices 33D. The notch around the restriction orifice 33E prevents the seal 35 from closing the restriction orifice 33E. Thus, all fluid is forced to flow through the restriction orifice 33E. This greatly increases the fluid pressure which reduces the velocity of the rod 32. The direction of movement of the lower piston member 33 and rod 32 determines which seal 39 is moved to close the bypass orifices 33D. When the rod 32 is moved into the chamber 34C of the barrel 34, the upper seal flexes to close the bypass orifices 33D if the speed or velocity of the rod 32 exceed a certain amount. In addition, if the speed or velocity of the rod 32 and lower piston member 33 exceeds a predetermined amount, the seal 35 on the upper piston member 31 flexes to close off the bypass orifice in the upper piston member 31. By closing the orifices in the upper piston member 31, the fluid in the chamber 34C is forced to be compressed between the upper and lower piston members 31 and 33. If the orifices of the upper piston member 31 remain open, the hydraulic fluid and air in the cylinder 30 are compressed between the lower piston member 33 and the upper end of the cylinder 30. Air is more compressible than hydraulic fluid; therefore, removing the compression of air in the cylinder 30 by closing off the orifices of the upper piston member 31, reduces the spongeyness of the compression of the fluid in the cylinder 30 which provides better reaction time.

The bypass orifices 33D in the piston members 31 and 33 allow the fluid to flow unrestricted provided the speed of the rod 32 and lower piston member 33 does not exceed the predetermined limit. Once the speed of the rod 32 and lower piston member 33 has been reduced to or below the maximum speed limit, the seals 35 and 39 again move to open the bypass orifices 33D and allow the damper cylinder 30 to again operate in the unrestricted manner. Once the work surface 102 has reached the desired height, the user applies the brake 90 by releasing the lever 92 of the brake 90 to activate the wrap spring.

In the preferred embodiment, the maximum speed limit after which the damper 30 begins to exert a force is 4.0 inches/second (10.2 cm/s) which translates to 8.0 inches/second (20.3 cm/s) of travel for the work surface 102. The ratio of travel of the counterbalance mechanism 10 to the work surface 102 is preferably 1:2. When the speed of movement of the work surface 102 is equal to or less than 8.0 inches/second (20.3 cm/s), the damper 30 exerts no force. In the preferred embodiment, the damper 30 provides instantaneous correction of the speed of the work surface 102 to or below the maximum speed limit. The damper 30 is used to prevent the work surface 102 from raising or lowering suddenly if a load is added or removed from the work surface 102 such that the adjusted preload force setting of the apparatus 10 is incorrect.

Figure 7:
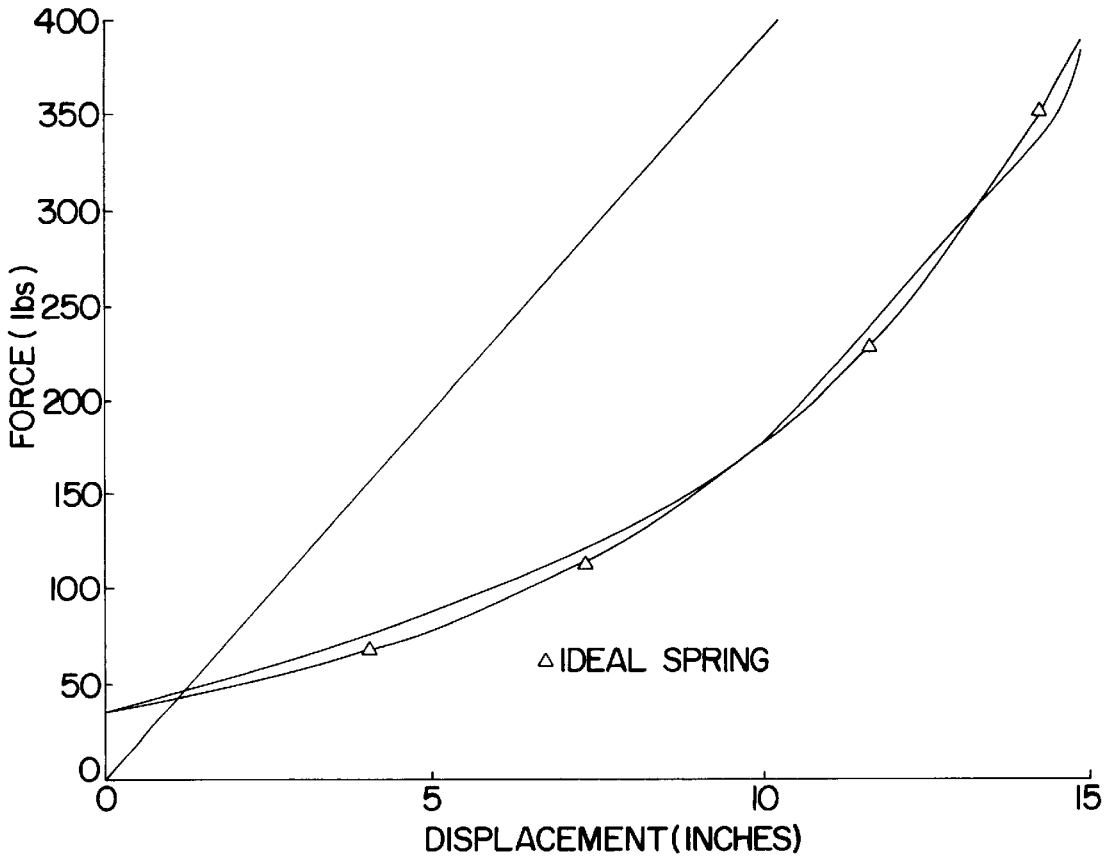
FIG. 7 is a graph showing the displacement of the combined coil springs 46 and 47 as a result of an applied force and the displacement of a ideal spring as a result of the same applied force.
Figure 8:
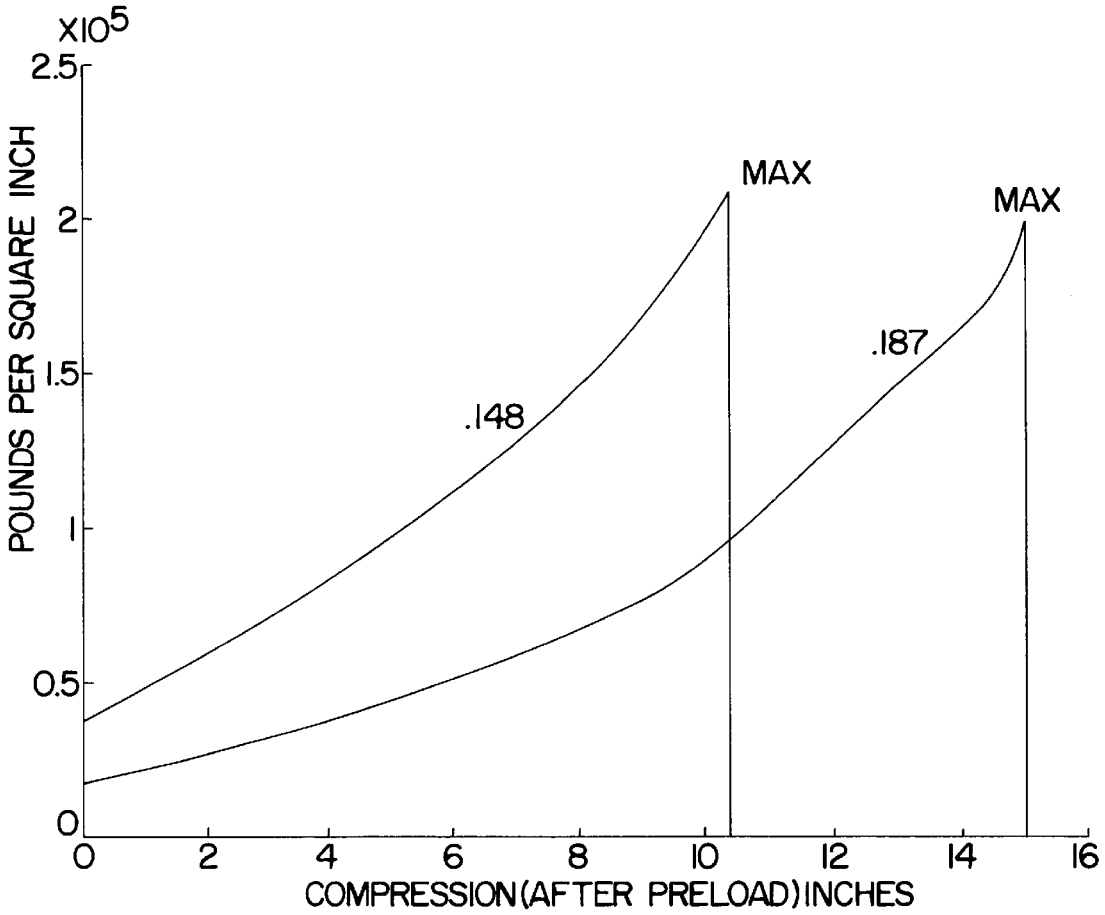
FIG. 8 is a graph showing the compression of each individual spring 46 and 47 as a result of an applied force.

In the preferred embodiment, the completely compressed height of the work station 100 from the ground surface to the top of the work surface 102 is 26.00 inches (66.04 cm) with a fully uncompressed height of 42.0 inches (106.7 cm) equalling a total travel distance for the work surface 102 of 16.0 inches (40.64 cm). The total vertical length of travel of the inner cam rollers 58 along inner cam surfaces 26 is 7.9 inches (20.1 cm). The total vertical length of travel of the outer cam rollers 60 and 62 along the outer cam surfaces 20 and 22 is 8.1 inches (20.6 cm) giving a total vertical travel of 16 inches (40.6 cm). The slope of the outer cam surfaces 20 and 22 is preferably 4:1. The connector arms 50 preferably have a length of between about 8.5 to 9.0 inches (21.6 to 22.9 cm). The rod 32 of the damper cylinder 30 preferably moves a total distance of about 7.9 inches (20.1 cm). In the preferred embodiment, the upper, weaker spring 47 has an inside diameter of 1.037 inches (3.577 cm) and an outer diameter of 1.333 inches (3.386 cm) with a K at pitch start of 0.1519 and a K at pitch end of 0.6078. The total uncompressed length of the upper spring 47 is 15.49 inches (39.35 cm). Preferably, the lower, stronger spring 46 has an inside diameter of 0.825 inches (2.096 cm) and an outside diameter of 1.199 inches (3.045 cm). The K at pitch start for the lower spring 46 is 0.3823 and the K at pitch end is 0.4201. The total uncompressed length of the lower spring 46 is 18.42 inches (46.78 cm). K for the combined springs 46 and 47 is 0.1614 throughout the entire compression of the springs 46 and 47. The total length of the springs 46 and 47 in the uncompressed state is 33.91 inches (86.13 cm) (FIGS. 7 and 8). The total length of the springs 46 and 47 in the completely compressed state is 15.0 inches (38.1 cm). In the preferred embodiment, the preload is 3.9153.

It is intended that the foregoing description be only illustrative of the present invention and that the present invention be limited only by the hereinafter appended claims.

I claim:

1. In a counterbalance apparatus, the improvement which comprises:

(a) a first member defining a longitudinal axis and having opposed ends with at least one wall between the ends;

(b) a second member slidably mounted along the first member so as to be along the longitudinal axis and having opposed ends with at least one wall between the ends of the second member;

(c) a pair of first cam surfaces located on the wall of the first member such that one first cam surface is a mirror image of the other first cam surface on opposed sides of the longitudinal axis;

(d) a pair of second cam surfaces located on the wall of the second member such that one second cam surface is a mirror image of the other second cam surface on opposed sides of the longitudinal axis wherein each of the first cam surfaces of the pair of first cam surfaces defines oppositely inclined paths relative to each of the respective second cam surfaces of the pair of second cam surfaces and wherein with the first and second members in an extended position, each of the first cam surfaces of the pair of first cam surfaces is spaced apart from each of the respective second cam surfaces of the pair of second cam surfaces with a space between them in a plane perpendicular to a plane formed by the wall of the first member and wherein each of the respective first and second cam surfaces are located one above the other along the longitudinal axis;

(e) a pair of cam followers positioned adjacent and in contact with the pairs of first and second cam surfaces in the space between each of the first and the second cam surfaces and which move in the oppositely inclined paths defined by the first and second cam surfaces; and (f) a resilient member with opposed ends and connected at one end to the pair of cam followers and at the other end to the second member so that the first and second members are biased in the extended position and so that when the resilient member is compressed, the cam followers move along the oppositely inclined paths of the first and second cam surfaces as the first and second members are moved together to provide a counterbalance for a weight on one of the opposed ends of the first and second members.

2. The counterbalance apparatus of claim 1 wherein the pairs of first and second cam surfaces are inclined so as to provide increasing leverage so that a relatively constant force can be applied between the ends of the first and second members which are distal to each other to move the members together.

3. The counterbalance apparatus of any one of claims 1 or 2 wherein a dampening means having opposed ends is connected at one end to one of the ends of the second member with the cam followers connected to the other one of the ends of the dampening means.

4. The counterbalance apparatus of claim 3 wherein the resilient member is mounted around the dampening means and wherein an adjustment means is mounted on the dampening means for varying a length of and thus compression of the resilient member.

5. The counterbalance apparatus of claim 4 wherein the adjustment means is rotatable for compression and decompression of the resilient member and includes a rotatable, threaded member on the dampening means and a threaded retaining means mounted on the threaded member and wherein, the retaining means engages a portion of the second member to prevent rotation of the retaining means.

6. The counterbalance apparatus of any one of claims 1 or 2 wherein a dampening means having opposed ends is connected at one end to one of the ends of the second member with the cam followers connected to the other end of the dampening means and wherein the resilient member is a coil spring mounted inside of the second member and around the dampening means so as to bias the members apart.

7. The counterbalance apparatus of claim 6 wherein the coil spring includes a first and second coil spring.

8. The counterbalance apparatus of claim 7 wherein the first and second coil springs have a different spring constant and compress at different rates.

9. The counterbalance apparatus of any one of claims 1 or 2 wherein a dampening means having opposed ends is connected at one end to one of the ends of the second member with the cam followers connected to the other end of the dampening means, wherein the resilient member is a coil spring and is mounted inside of the second member and around the dampening means so as to bias the members apart and wherein the coil spring has non-linear coils along a length of the coil spring so as to require a variable force to compress the coil spring along the length.

10. The counterbalance apparatus of any one of claims 1 or 2 wherein a dampening means having opposed ends is connected at one end to one of the ends of the second member with the cam followers connected to the other end of the dampening means, wherein the resilient member is a coil spring and is mounted inside of the second member and around the dampening means so as to bias the members apart and wherein an adjustment means is mounted on the dampening means for varying a length and thus compression of the coil spring.

11. The counterbalance apparatus of any one of claims 1 or 2 wherein a dampening means having opposed ends is connected at one end to one of the ends of the second member with the cam followers connected to the other of the ends of the dampening means, wherein the resilient member is a coil spring and is mounted inside of the second member and around the dampening means so as to bias the members apart and wherein the coil spring has non-linear coils along a length of the coil spring so as to require a variable force to compress the coil spring along the length and wherein an adjustment means is mounted on the dampening means for varying the length of and thus compression of the coil spring.

12. The counterbalance apparatus of any one of claims 1 or 2 wherein a dampening means having opposed ends is connected at one of the ends to one of the ends of the second member with the cam followers connected to the other one of the ends of the dampening means, wherein the resilient member is a coil spring and is mounted inside of the second member and around the dampening means so as to bias the members apart and wherein a rotatable adjustment means for compression or decompression of the coil spring includes a threaded member on the dampening means and a threaded retaining means mounted on the threaded member, the threaded retaining means engaging a portion of the second member which prevents rotation of the threaded retaining means.

13. The counterbalance apparatus of any one of claims 1 or 2 wherein a dampening means having opposed ends is connected at one end to one of the ends of the second member with the cam followers connected to the other end of the dampening means, wherein the resilient member is a coil spring and is mounted inside of the second member and around the dampening means so as to bias the members apart, wherein the coil spring has non-linear coils along a length of the coil spring to require a variable force to compress the coil spring along the length, wherein a rotatable adjustment means for compression or decompression of the coil spring is mounted on the dampening means for varying the length of the coil spring and wherein the adjustment means includes a threaded member on the dampening means and a threaded retaining means mounted on the threaded member, the threaded retaining means engaging a portion of the second member which prevents rotation of the threaded retaining means.

14. The counterbalance apparatus of any one of claims 1 or 2 wherein a dampening means having opposed ends is connected at one of the ends to one of the ends of the second member with the cam followers connected to the other of the ends of the dampening means, and wherein the resilient member is a coil spring and is mounted inside of the second member and around the dampening means to bias the members apart, wherein the coil spring has non-linear coils along a length of the coil spring so as to require a variable force to compress the coil spring along the length, wherein a rotatable adjustment means for compression or decompression of the coil spring is mounted on the dampening means for varying the length of the coil spring, wherein the adjustment means includes a threaded member on the dampening means and a threaded retaining means mounted on the threaded member, the threaded retaining means engaging a portion of the second member to prevent rotation of the threaded retaining means and wherein the coil spring extends between the retaining means and a bracket connected to the cam followers.

15. The counterbalance apparatus of claims 1 or 2 wherein the second and first members have a rectangular cross-section.

16. The apparatus of claims 1 or 2 wherein a dampening means having opposed ends is connected at one end to one of the ends of the second member with the cam followers connected to the other end of the dampening means, and wherein the resilient member is a coil spring and is mounted inside of the second member and around the dampening means to bias the members apart, wherein the coil spring has non-linear coils which require a variable force to compress the coil spring along a length of the coil spring, wherein a rotatable adjustment means for compression or decompression of the coil spring is mounted on the dampening means for varying the length of the coil spring when the members are biased apart, and wherein the adjustment means includes a threaded member on the dampening means and a threaded retaining means mounted on the threaded member, the retaining means engaging a portion of the second member wherein the coil spring has ends which extend between the retaining means and a bracket connected to the cam followers and wherein the second and first tubular members have a rectangular cross-section.

17. The counterbalance apparatus of any one of claims 1 or 2 wherein the one end of the resilient member is mounted in a bracket which is connected by a pair of pivotable connector arms to the pair of cam followers.

18. The counterbalance apparatus of any one of claims 1 or 2 wherein the first member has a front wall parallel to and spaced apart from a back wall and wherein a pair of front first cam surfaces are mounted on the front wall and a pair of back first cam surfaces are mounted on the back wall.

19. The counterbalance apparatus of claim 18 wherein the cam followers include front and back first cam rollers which contact and move along the front and back first cam surfaces respectively, and second cam rollers spaced between the front and back first cam rollers which contact and move respectively along the second cam surfaces.

20. The counterbalance apparatus of any one of claims 1 or 2 wherein the cam followers include first cam rollers which respectively contact and move along the first cam surfaces and second cam rollers which respectively contact and move along the second cam surfaces.

21. A work station with a counterbalance movable work surface and a support means for the work surface of the work station with a counterbalance apparatus within the support means for movement of the work surface which comprises:

(a) the counterbalance apparatus including a first member defining a longitudinal axis and having opposed ends with at least one wall between the ends; a second member slidably mounted along the first member so as to be along the longitudinal axis and having opposed ends with at least one wall between the ends of the second member; a pair of first cam surfaces located on the wall of the first member such that one first cam surface is a mirror image of the other first cam surface on opposed sides of the longitudinal axis; a pair of second cam surfaces located on the wall of the second member such that one second cam surface is a mirror image of the other second cam surface on opposed sides of the longitudinal axis wherein each of the first cam surfaces of the pair of first cam surfaces defines oppositely inclined paths relative to each of the respective second cam surfaces of the pair of second cam surfaces and wherein with the first and second members in an extended position, each of the first cam surfaces of the pair of first cam surfaces is spaced apart from each of the respective second cam surfaces of the pair of second cam surfaces with a space between them in a plane perpendicular to a plane formed by the wall of the first member and wherein each of the respective first and second cam surfaces are located one above the other along the longitudinal axis; a pair of cam followers positioned adjacent and in contact with the pairs of first and second cam surfaces in the space between each of the first and the second cam surfaces and which move in the oppositely inclined paths defined by the first and second cam surfaces; and a resilient member with opposed ends and connected at one end to the pair of cam followers and at the other end to the second member so that the first and second members are biased in the extended position and so that when the resilient member is compressed, the cam followers move along the oppositely inclined paths of the first and second cam surfaces as the first and second members are moved together to provide a counterbalance for a weight on one of the opposed ends of the first and second members; and (b) locking means adjacent the counterbalance apparatus for securing the work surface of the work station against movement.

22. The work station of claim 21 wherein the first and second cam surfaces are inclined so as to provide increasing leverage so that a relatively constant force can be applied between the ends of the members which are distal to each other to move the members together.

23. The work station of any one of claims 21 or 22 wherein a damper having opposed ends is connected at one end to one of the ends of the second member with the cam followers connected to the other one of the ends of the damper.

24. The work station of any one of claims 21 or 22 wherein a damper having opposed ends is connected at one end to one of the ends of the second member with the cam followers connected to the other end of the damper and wherein the resilient member is a coil spring mounted inside of the second member and around the damper so as to bias the members apart.

25. The work station of any one of claims 21 or 22 wherein a damper having opposed ends is connected at one end to one of the ends of the second member with the cam followers connected to the other end of the damper, wherein the resilient member is a coil spring and is mounted inside of the second member and around the damper so as to bias the members apart and wherein the coil spring has non-linear coils along a length of the coil spring so as to require a variable force to compress the coil spring along the length.

26. The work station of any one of claims 21 or 22 wherein a damper having opposed ends is connected at one end to one of the ends of the second member with the cam followers connected to the other end of the damper wherein the resilient member is mounted around the damper, and wherein an adjustment means is mounted on the damper for varying a length of and thus compression of the resilient member.

27. The work station of any one of claims 21 or 22 wherein the work surface has a first and second support means and wherein a first and second counterbalance apparatus is mounted in the first and second support means, respectively.

28. The work station of claim 27 wherein the first and second counterbalance apparatuses are connected together by an alignment rod.

29. The work station of claim 28 wherein the rod is connected to an alignment mechanism located in the first counterbalance apparatus and wherein the alignment mechanism rotates the rod in response to raising or lowering of the work surface to ensure that the second counterbalance apparatus raises and lowers at a same rate as the first counterbalance apparatus.

30. The work station of claim 29 wherein the alignment mechanism includes a chain, a sprocket and a bracket with the sprocket mounted on an end of the rod located in the first counterbalance apparatus and the bracket mounted at an end of a second member of the first counterbalance apparatus and wherein the chain extends around the sprocket and around the bracket to form a loop and wherein the chain is fastened to the second member such that when the second member raises or lowers, the chain moves with the second member which rotates the sprocket and the rod.

31. The work station of claim 28 wherein the locking means is mounted on the alignment rod to prevent the work surface from being raised or lowered.

32. The work station of claim 31 wherein the locking means is a spring wrap brake.

33. The work station of claim 31 wherein the locking means is released by a hand activated lever.

34. The work station of claim 27 wherein an adjustment means is mounted adjacent one end of the resilient member for each of the first and second counterbalance apparatuses.

35. The work station of claim 34 wherein a first sprocket is mounted on the adjustment means of the first counterbalance apparatus and is connected by a chain to a second sprocket mounted on the adjustment means of the second counterbalance apparatus such that an adjustment of a compression of the resilient member of the first counterbalance apparatus results in a corresponding adjustment of a compression of a resilient member of the second counterbalance apparatus.

36. In a counterbalance apparatus, the improvement which comprises:

(a) a first member defining a longitudinal axis and having opposed ends with at least one wall between the ends;

(b) a second member slidably mounted along the first member so as to be along the axis and having opposed ends with at least one wall between the ends of the second member;

(c) a pair of first cams attached to the first member, a pair of second cams attached to the second member, each of the cams extending between the first member and the second member, each of the cams of the pair of first cams comprises a corresponding first cam surface, each of the cams of the pair of second cams comprises a corresponding second cam surface, each of the first cam surfaces of the pair of first cams define oppositely inclined paths relative to each of the respective second cam surfaces of the pair of second cams;

(d) cam followers which move in the oppositely inclined paths with respect to the longitudinal axis and wherein at least one of the second member or first member is movable along the longitudinal axis relative to the other of the second member or first member to move the members together; and (e) a force storage mechanism with opposed ends which is connected at one end to the cam followers and at the other end to one end of the second member so as to bias the members apart.

37. The counterbalance apparatus of claim 36 wherein the first and second cam surfaces are inclined so as to provide increasing leverage so that a relatively constant force can be applied between the ends of the members which are distal to each other to move the members together.

38. The counterbalance apparatus of any one of claims 36 or 37 wherein a damper having opposed ends is connected at one end to one of the ends of the second member with the cam followers connected to the other one of the ends of the damper.

39. The counterbalance apparatus of any one of claims 36 or 37 wherein a damper having opposed ends is connected at one end to one of the ends of the second member with the cam followers connected to the other end of the damper and wherein the force storage mechanism is a coil spring mounted inside of the second member and around the damper so as to bias the members apart.

40. The counterbalance apparatus of any one of claims 36 or 37 wherein a damper having opposed ends is connected at one end to one of the ends of the second member with the cam followers connected to the other end of the damper, wherein the force storage mechanism is a coil spring and is mounted inside of the second member and around the damper so as to bias the members apart and wherein the coil spring has non-linear coils along a length of the coil spring so as to require a variable force to compress the coil spring along the length.

41. The counterbalance apparatus of any one of claims 36 or 37 wherein a damper having opposed ends is connected at one end to one of the ends of the second member with the cam followers connected to the other end of the damper wherein the force storage mechanism is mounted around the damper and wherein an adjustment means is mounted on the damper for varying a length of and thus compression of the force storage mechanism.

* * * * *